US006195812B1

(12) United States Patent
McRobert

(10) Patent No.: US 6,195,812 B1
(45) Date of Patent: Mar. 6, 2001

(54) SYSTEM FOR RAISING AND LOWERING A LINER OF A FLUID BEARING RECEPTACLE

(76) Inventor: Ian McRobert, 24 Celosia Way, Ferndale, Western Australia 6148 (AU)

( * ) Notice: Subject to any disclaimer, the term of this patent is extended or adjusted under 35 U.S.C. 154(b) by 0 days.

(21) Appl. No.: 09/341,005

(22) PCT Filed: Dec. 30, 1997

(86) PCT No.: PCT/AU97/00891

§ 371 Date: Jun. 30, 1999

§ 102(e) Date: Jun. 30, 1999

(87) PCT Pub. No.: WO98/29624

PCT Pub. Date: Jul. 9, 1998

(30) Foreign Application Priority Data

Dec. 30, 1996 (AU) ..... P04409

(51) Int. Cl.[7] ..... E04H 4/00
(52) U.S. Cl. ..... 4/501; 4/495; 4/498
(58) Field of Search ..... 4/501, 498, 499, 4/495, 494, 504

(56) References Cited

U.S. PATENT DOCUMENTS 3,780,385 * 12/1973 Dunn ..... 4/501
3,816,859 * 6/1974 Mosehauer ..... 4/501

FOREIGN PATENT DOCUMENTS

25740 * 12/1978 (AU) ..... 4/498
2046589 * 11/1980 (GB) ..... 4/501

* cited by examiner

*Primary Examiner*—Steven O. Douglas
*Assistant Examiner*—Khoa D Huynh
(74) *Attorney, Agent, or Firm*—James Ray & Associates

(57) ABSTRACT

A system (10) for raising and lowering a swimming pool liner (12) includes a plate (22) used to define a spill way (24) for providing fluid communication between an outside surface of the liner and an inside surface (16) of the pool (14). The liner is detached from the surface of the pool in the region behind the plate and reattached along an upper edge (28) of the plate. Conduit (30), having length (30'), extends along back face (32) of plate (22) and below the upper edge (28). Holes (34) cut in the plate provide communication with length (30'). Conduit (36) extends across the back face (32) near its lower edge (38) to provide air to the spill way (24). The length (36') of conduit (36) is provided with a number of holes (40) for admitting air into the spill way. In order to lift the liner, air is directed through conduit (30) to the outside surface (26) of the liner. The air lifts the liner up and away from the inside surface (16) displacing water held within the pool to flow over upper edge (28) into the spill way so that the water now lies beneath the outside surface.

13 Claims, 2 Drawing Sheets

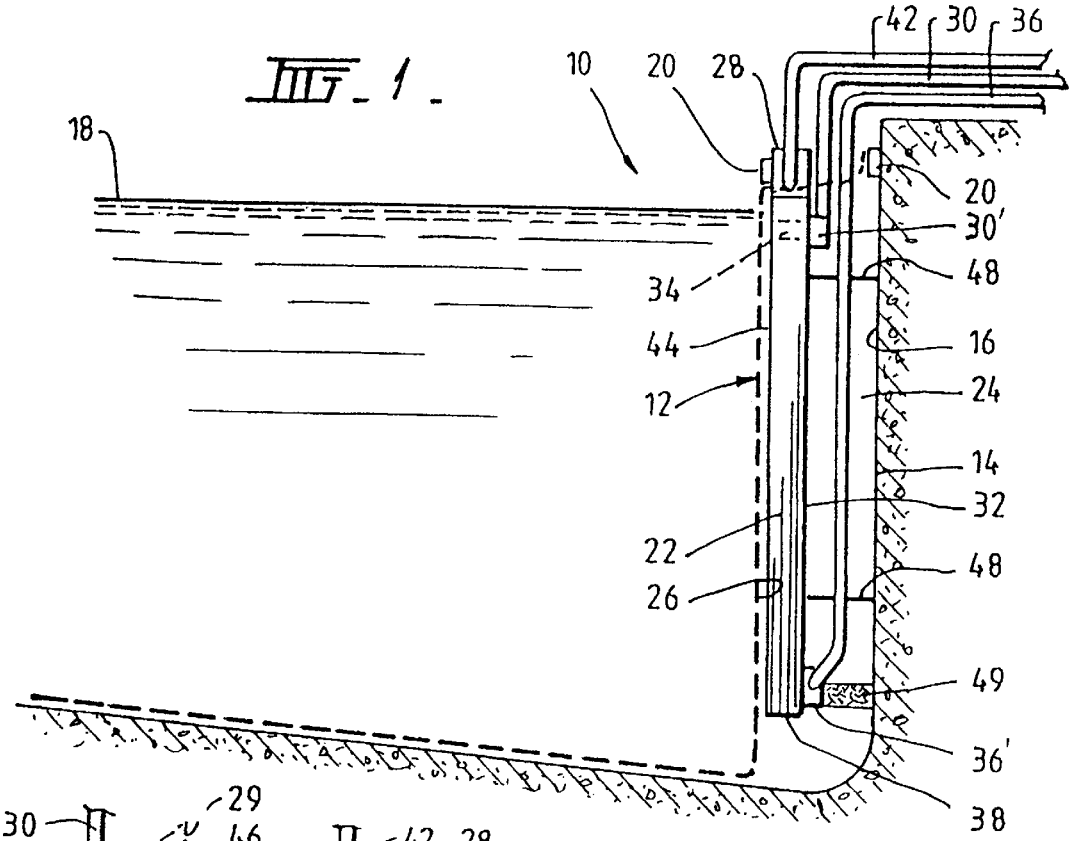
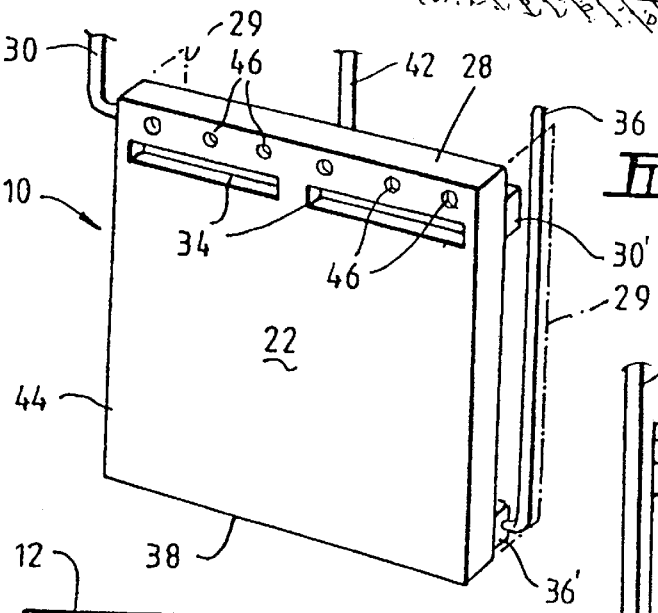
FIG. 2.
FIG. 4.
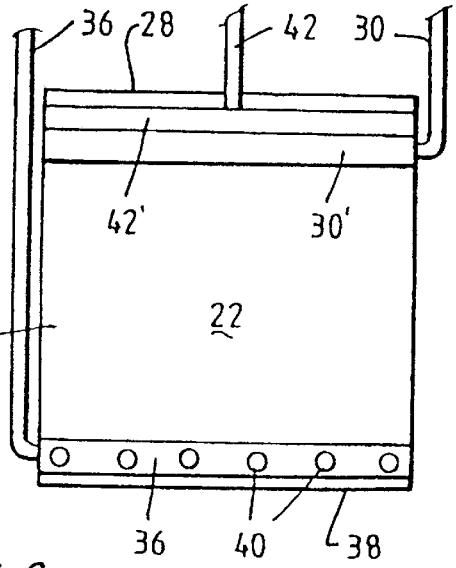
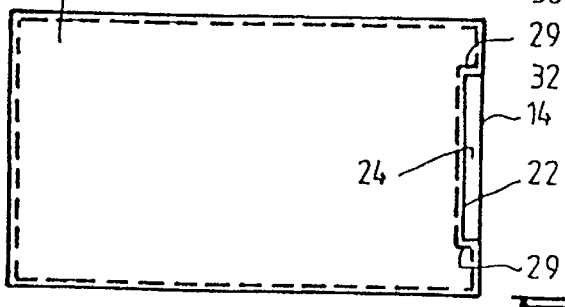
FIG. 3.

SYSTEM FOR RAISING AND LOWERING A LINER OF A FLUID BEARING RECEPTACLE

FIELD OF THE INVENTION

The present invention relates to a system for raising and lowering a liner of a fluid bearing receptacle such as, but not limited to, a swimming pool, aquaculture tank or chemical storage tank. The present invention further relates to a liftable liner system for a fluid bearing receptacle.

BACKGROUND OF THE INVENTION

There are many situations where it would be beneficial to access the bottom of a fluid bearing receptacle, for example for cleaning purposes or for recovery of items. In a more specific example in the case of swimming pool, it is often desirable to access the bottom of the swimming pool for the removal of debris. Presently, debris can be removed by way of automatic pool cleaners such as the KREEPY KRAULY pool cleaner or by a manual vacuum system attached with the pool filtering system. However, such methods are particularly slow. In another application, for example in commercial marine animal breeding tanks, it is at times desirable to access the lower portions of the tank in order to remove the marine animals for sale or consumption as well as to clean the bottom of the tank.

SUMMARY OF THE INVENTION

The present invention was developed with a view to providing a system for allowing access to the contents of the receptacle without needing to empty the receptacle.

According to a first aspect of the present invention there is provided a system for raising and lowering a liner of a fluid bearing receptacle, said liner attached along its peripheral edge to said receptacle, said system including:

a first baffle means adapted for connection to said receptacle in a manner so as to form a spillway which provides fluid communication between an outside surface of said liner and an inside surface of said receptacle, said liner being detached from said receptacle in the region of said baffle means and reattached along its peripheral edge to an upper edge of said baffle means;

first means for supplying a gas to the outside surface of said liner; and, second means for supplying a gas to said spillway;

whereby, in use, when a fluid is held within said receptacle on the inside surface of said liner so as to hold said liner in a lining position with its outside surface in contact with the inside surface of said receptacle and said first baffle means, a gas can be passed through said first means to progressively lift said liner up and away from the inside surface of said receptacle thereby displacing fluid held on the inside surface of said liner to flow over the upper edge of said baffle means down said spillway and between the outside surface of said liner and the inside surface of said receptacle until substantially all of said fluid is so displaced, raising said liner to a covering position in which it covers said fluid, and a gas can be passed through said second means to lift said fluid up said spillway and over said upper edge of said baffle means onto the inside surface of said liner progressively lowering said liner back to said lining position.

Preferably said first means is in the form of a conduit or manifold having a length which extends along or near the upper edge of said baffle means.

Preferably said second means comprises a conduit or manifold having a length extending along or near a lower edge of said baffle means.

Preferably said first conduit or manifold is formed on a side of said baffle means adjacent the inside surface of said receptacle and said baffle means is provided with one or more openings to provide fluid communication between said conduit or manifold and said outside surface of said liner.

Preferably said baffle means is in the form of a plate shaped or otherwise configured to be spaced from a side wall of said receptacle.

In an alternate embodiment, said baffle means is in the form of one or more plates which extend across and down respective corners of said receptacle.

Preferably said system further includes third means for allowing evacuation of gas entrapped between the outside surface of said liner and said fluid when said liner is in said raised position so that said liner, when in the covering position, can sit on said fluid.

Preferably said system further includes filter means for filtering fluid as it flows through said spillway.

According to another aspect of the present invention there is provided a liftable liner system for a fluid bearing receptacle including:

a flexible liner shaped to conform to an inside surface of said receptacle;

first baffle means adapted for connection to said receptacle in a manner so as to form a spillway which provides fluid communication between an outside surface of said liner and an inside surface of said receptacle, said liner being attached along its peripheral edge to said receptacle and an upper edge of said first baffle means;

first means for supplying a gas to the outside surface of said first baffle means; and, second means for supplying a gas to said spillway;

whereby, in use, when a fluid is held within said receptacle on the inside surface of said liner so as to hold said liner in a lining position with its outside surface in contact with the inside surface of said receptacle and said first baffle means, a gas can be passed through said first means to progressively lift said liner up and away from the inside surface of said receptacle thereby displacing fluid held on the inside surface of said liner to flow over the upper edge of said baffle means down said spillway and between the outside surface of said liner and the inside surface of said receptacle until substantially all of said fluid is so displaced, raising said liner to a covering position in which it covers said fluid, and a gas can be passed through said second means to lift said fluid up said spillway and over said upper edge of said baffle means onto the inside surface of said liner progressively lowering said liner back to said lining position.

BRIEF DESCRIPTION OF THE DRAWINGS

Embodiments of the present invention will now be described by way of example only with reference to the accompanying drawings in which:

FIG. 1 is a cross-sectional view of a swimming pool incorporating a first embodiment of the present system for raising and lowering a liner;

FIG. 2 is a isometric view from the front of a baffle incorporated in the system shown in FIG. 1;

FIG. 3 is a view from the top of the swimming pool shown in FIG. 1;

FIG. 4 is a back view of the baffle shown in FIG. 2 incorporating a second embodiment of the system;

DETAILED DESCRIPTION OF THE PREFERRED EMBODIMENT

Figure 5:
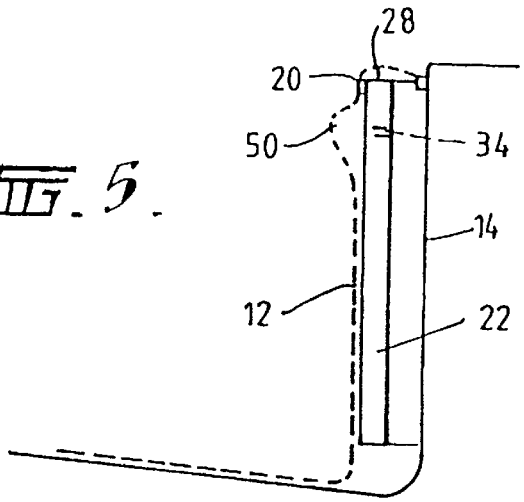
FIGS. 5 to 7 show schematically the progressive raising of the liner shown in FIG. 1.

A first embodiment of a system 10 for raising and lowering a liner 12 (shown in broken line) of a swimming pool 14 is illustrated in FIGS. 1–4. The liner 12 may be already provided with the swimming pool 14 or may be retrofitted later as part of the system 10. The liner 12 is attached about its peripheral edge to the inside surface 16 of the swimming pool typically at a level above the normal water line 18. The attachment of the liner 12 to the inside surface 16 is typically by way of a rib locking strip 20 which does not form part of the present invention.

The system 10 for raising and lowering the liner 12 includes a first baffle means in the form of plate 22 which defines a spillway 24 for providing fluid communication between an outside surface 26 of the liner and the inside surface 16 of the pool 14. The liner 12 is detached from the inside surface 16 of the pool in the region behind the plate 22 and reattached along upper edge 28 of the plate 22 by use of a conventional locking strip 20. This detaching and reattaching of the liner 12 and formation of the spillway 24 is most clearly seen in FIG. 3. The liner 12 is attached to the pool 14 and plate 22 in a continuous air tight manner. In this embodiment, this is achieved by extending the sides 29 of the plate 22 backwardly so that they abut and can be sealed against the inside surface 16 of the pool 14 and extending the locking strip 20 along the sides 29.

A first means, in the form of a conduit 30, is provided for supplying a gas, such as air, to the outside surface 26, and more particularly for supplying air between surfaces 26 and 16. The conduit 30 has a length 30' which extends along backface 32 of plate 22 just below the upper edge 28. Rectangular holes or slots 34 are cut in the plate 22 to communicate with the length 30'. Thus, the conduit 30/30' is able to provide air to the outside surface 26 of the liner.

A second means in the form of conduit 36 having a length 36' which extends across the back face 32 of plate 22 near its lower edge 38 is provided for supplying a gas, such as air, to the spillway 24. The length 36' is provided with a number of holes 40 for admitting air into the spillway 24.

A conduit 42 is provided to allow fluid communication between a front face 44 of the plate 22 and the outside surface 26 of the liner above the normal water line 18; and, the atmosphere. The conduit 42 has a length 42' which extends across the backface 32 of plate 22 above the length 30'. The length 42' is in communication with holes 46 formed along the plate 22. It is envisaged that the conduit 42 can also be connected with a vacuum source such as a venturi device.

A number of spacers 48 extend between the backface 32 of the plate 22 and the inside surface 16 of the swimming pool. The spacers 48 provide the necessary spacing between the plate 22 and pool 14 to form the spillway 24. The spacers can also provide a means for connecting the plate 22 to the inside of the pool 14.

A debris trap/filter 49 is located between back face 23 of plate 22 and the inside surface 16 adjacent the length 36'. The trap/filter 49 is in the form of a length of mesh which extends for the width of the plate 22.

The operation of the system 10 will now be described.

Assume, that the swimming pool 14 is empty and has its own liner 12 with the shell of the pool 14 being substantially impervious to water and the system 10 has not yet been installed. To install the system 10, a length of the liner 12 approximately equal to the length of the plate 22 is detached from the rib locks strip 20 on the inside surface 16 of the swimming pool 14. Plate 22 is then lowered between the outside surface 26 of the liner 14 and the inside surface 16 of the pool 14. The plate 22 is then fixed in place by any conventional means. Conduits 30 and 36 is coupled to a fan through a valving system (not shown) for selectively supplying air to respective lengths 30' and 36'. Similarly, the conduit 42, (if provided) can be coupled with a vacuum device. The portion of the liner 12 detached from the swimming pool 14 is now re-attached along the upper edge 28 of the plate 22 and the pool filled with water in a conventional manner to level 18.

Figure 6:
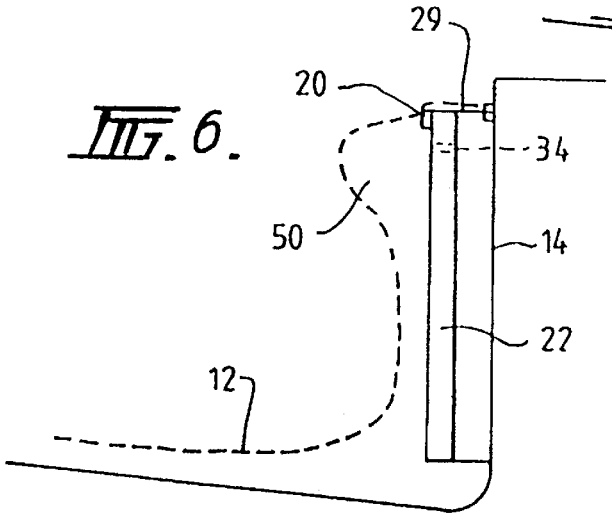
Figure 9:
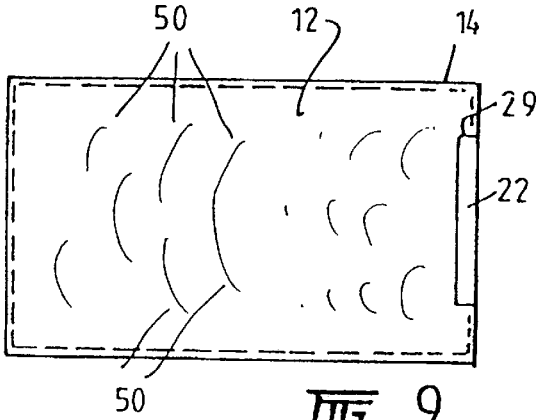

When the swimming pool is in normal use, water sits on the inside surface of the liner 12 holding it into close conformity with the shape of the inside surface 16. When it is desired to clean the swimming pool 14 for the purposes of removing debris from the bottom of the pool or for cleaning the liner itself, air is directed through conduit 30/30' to the outside surface 26 of the liner 12. The air takes the path of least resistance which is along the rib lock strip 20. The air progressively lifts the liner up and away from the inside surface 16 forming initially a bulge 50 (refer to FIGS. 5, 6 and 9) around the peripheral edge of the liner 12 immediately below the rib locking strip 20. The lifting of the liner up and away from the surface 16 displaces the water held within the pool 14 so as to flow over the upper edge 28 into the spillway 24. This water now lies beneath the outside surface 26 of liner 12.

Figure 7:
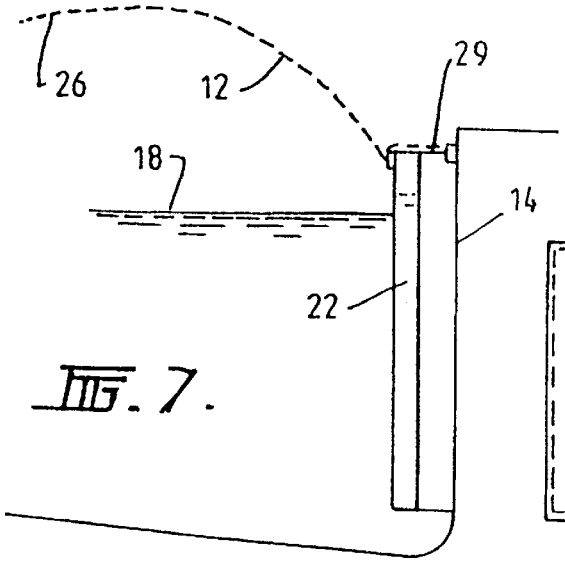

As air is continually passed through conduit 30/30', the size of the bulge 50 increases displacing further water to flow through the spillway 24. Progressively, the liner 12 is raised as more and more water flows through the spillway (refer FIG. 6). Eventually, substantially all of the water previously held on the inside of the liner 12 is now held between the inside surface 16 of the pool and the outside surface 26 of the liner as shown in FIG. 7. Indeed, the liner 12 balloons above the level 18 of the water. At this time, the supply of air to conduits 30/30' can be stopped.

Figure 8:
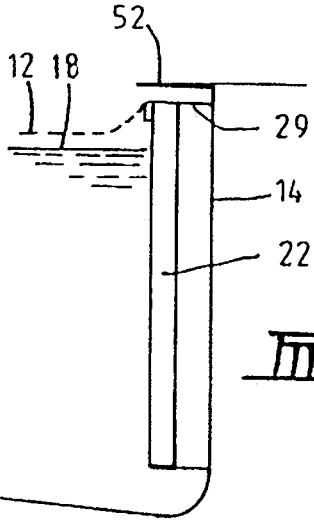
FIG. 8 shows the liner of FIGS. 1 and 5 to 7 in a covering position sitting on the water in the swimming pool; and, FIG. 9 is a top view of the liner in the swimming pool shown in FIG. 5.

If desired, the liner 12 can be maintained in this position for a period of time to allow drying and/or radiation with ultraviolet light (from the sun), or for scrubbing and cleaning. However, it may be preferable for the liner 12 to be returned to a position so as to sit on top of the water as shown in FIG. 8. This can be achieved by opening conduit 42 to the atmosphere so that air entrapped between the water line 18 and outside surface 26 can bleed to the atmosphere. Alternately, to speed up the evacuation of this air, the conduit 42 can be attached to a vacuum device. It will be appreciated that when the liner 12 sits on top of and covers the water, not only can the liner 12 be cleaned but it also prevents additional debris from entering the water. Further benefits include reducing evaporation and acting as a safety barrier. It is envisaged that the liner 12 can be raised to the covering position shown in FIG. 8 when the swimming pool 14 is not in use.

The debris trap/filter 49 prevents foreign matter which may initially be on the inside surface of the liner 12 from passing to the outside surface 26.

To return the liner 12 to its lining position in which it sits in close conformity to the inside surface 16 of the pool and against the front face 44 of a plate 22 air is now passed through conduit 36/36' into the spillway 24. As the air rises, it carries water up the spillway and over the upper edge 28 of the plate 22 onto the inside surface of the liner 12. This motion of the water can be enhanced by the provision of an air directing plate 52 across the top of the spillway 24 extending in a horizontal plane and toward the plate 22 to a point adjacent or passed the upper edge 28. The weight of the water on the inside of the liner 12 assists in lowering or sinking the liner 12 back to its lining position.

Now that an embodiment of the present invention has been described in detail, it will be apparent to those skilled in the relevant arts that numerous modifications and variations may be made without departing from the basic inventive concepts. For example, while the specific embodiments have been described in relation to a swimming pool, a system 10 can be applied to any type of fluid bearing receptacle such as chemical storage tanks and drums; ponds or tanks used for breeding marine animals; and water storage tanks. Also, in the embodiment described, the liner 12 was provided as part of the swimming pool 14. However, the liner can be fitted after the manufacture of the receptacle with, and as part of, the system 10. For example in the case of a fibreglass swimming pool which is not manufactured with a liner, the liner 12 can be added with the system 10.

Obviously, the system 10 can be applied to a receptacle of any shape. Further, the plate 22 can be of any desired shape and configuration provided that it can define or form a spillway 24 within the receptacle in which it is installed. For example, in the present embodiment the plate 22 can be made to extend across the full width of the pool 14. In that event, the sides 29 need not be extended backwardly. Rather the sides can be simply sealed to the inside surface 16 of the pool 14. (The sealing is only required to a depth below the rib locking strip 20 and need not extend the full depth of the plate 22). If the system 10 were installed in a cylindrical or round receptacle or tank, the plate 22 can be either planar as shown or can be of arcuate section. Also more than one plate 22 can be incorporated into the system 10. Further, the plates can take the form of elongate strips which extend across and down respective corners of a polygon-shaped receptacle tank.

The plumbing arrangement for the conduits 30/30'; 36/36'; and 42/42' can also be rearranged in any suitable form and configuration. Indeed, in one option, the conduit 42/42' can be dispensed with and the evacuation function performed by these conduits can be transferred to the conduit 30/30' provided that the openings 34 remain above the level of the fluid within the receptacle. This modification will require valving so as to selectively pass air to the outside surface 26 of the liner for raising the liner and to evacuate air trapped between the outside surface 26 and the water line 18.

In yet a further variation, the conduits 30/30', 36/36', and 42/42' can be provided as separate integers not physically connected with the plate 22. In particular, the conduit 42/42' can be provided at any location along the inside surface 16 of pool 14 at a level above the water line 18 and positioned so that it can evacuate air which may be trapped between the outside surface 26 and water line 18 when the liner 12 is raised. In this way, the upper edge 28 of the plate 22 can be submerged to below the water line 18. By the providing a conventional skimmer box of pool filtration system within the spillway 24, the provision of the system 10 would not interfere with the normal filtering cycle. Although, one further modification is required in this event. That being to raise the level of the filtered water returns to a point above the rib locking strip 20.

In yet a further variation a second baffle can be incorporated into the system 10 to assist in the emptying of the receptacle. The second baffle lies between the outside surface 26 of the liner 12 and the front face 48 of the plate 22 and extends parallel to but spaced from plate 22. The upper edge of the second baffle is preferably below the level of the rib locking strip 20 on the plate 22. The liner is simply draped over the second baffle and conduits 30/30' are configured and/or disposed to feed gas into the space between the plate 22 and second baffle. All other features of the system 10 remain substantially unchanged.

All such and further modifications and variations as would be apparent to those skilled in the relevant arts are considered to be within the scope of the present invention, the nature of which is to be determined from the foregoing description.

What is claimed is:

1. A system for raising and lowering a liner of a fluid bearing receptacle, said liner attached along its peripheral edge to said receptacle, said system including:

a first baffle means adapted for connection to said receptacle in a manner so as to form a spillway which provides fluid communication between an outside surface of said liner and an inside surface of said receptacle, said liner being detached from said receptacle in the region of said baffle means and reattached along its peripheral edge to an upper edge of said baffle means;

first means for supplying a gas to the outside surface of said liner; and, second means for supplying a gas to said spillway;

whereby, in use, when a fluid is held within said receptacle on the inside surface of said liner so as to hold said liner in a lining position with its outside surface in contact with the inside surface of said receptacle and said first baffle means, a gas can be passed through said first means to progressively lift said liner up and away from the inside surface of said receptacle thereby displacing fluid held on the inside surface of said liner to flow over the upper edge of said baffle means down said spillway and between the outside surface of said liner and the inside surface of said receptacle until substantially all of said fluid is so displaced, raising said liner to a covering position in which it covers said fluid, and a gas can be passed through said second means to lift said fluid up said spillway and over said upper edge of said baffle means onto the inside surface of said liner progressively lowering said liner back to said lining position.

2. A system according to claim 1 wherein said first means is in the form of a conduit or manifold having a length which extends along or near the upper edge of said baffle means.

3. A system according to claim 2 wherein said second means comprises a conduit or manifold having a length extending along or near a lower edge of said baffle means.

4. A system according to claim 3 wherein said first conduit or manifold is formed on a side of said baffle means adjacent the inside surface of said receptacle and said baffle means is provided with one or more openings to provide fluid communication between said conduit or manifold and said outside surface of said liner.

5. A system according to claim 4 wherein said baffle means is in the form of a plate shaped or otherwise configured to be spaced from a side wall of said receptacle.

6. A system according to claim 5 further including said system further includes third means for allowing evacuation of gas entrapped between the outside surface of said liner and said fluid when said liner is in said raised position so that said liner, when in the covering position, can sit on said fluid.

7. A system according to claim 5 further including filter means for filtering fluid as it flows through said spillway.

8. A system according to claim 4 wherein said baffle means is in the form of one or more plates which extend across and down respective corners of said receptacle.

9. A liftable liner system for a fluid bearing receptacle including:

a flexible liner shaped to conform to an inside surface of said receptacle;

first baffle means adapted for connection to said receptacle in a manner so as to form a spillway which provides fluid communication between an outside surface of said liner and an inside surface of said receptacle, said liner being attached along its peripheral edge to said receptacle and an upper edge of said first baffle means;

first means for supplying a gas to the outside surface of said first baffle means; and, second means for supplying a gas to said spillway;

whereby, in use, when a fluid is held within said receptacle on the inside surface of said liner so as to hold said liner in a lining position with its outside surface in contact with the inside surface of said receptacle and said first baffle means, a gas can be passed through said first means to progressively lift said liner up and away from the inside surface of said receptacle thereby displacing fluid held on the inside surface of said liner to flow over the upper edge of said baffle means down said spillway and between the outside surface of said liner and the inside surface of said receptacle until substantially all of said fluid is so displaced, raising said liner to a covering position in which it covers said fluid, and a gas can be passed through said second means to lift said fluid up said spillway and over said upper edge of said baffle means onto the inside surface of said liner progressively lowering said liner back to said lining position.

10. A system according to claim 9 wherein said first means is in the form of a conduit or manifold having a length which extends along or near the upper edge of said baffle means.

11. A system according to claim 10 wherein said second means comprises a conduit or manifold having a length extending along or near a lower edge of said baffle means.

12. A system according to claim 11 wherein said first conduit or manifold is formed on a side of said baffle means adjacent the inside surface of said receptacle and said baffle means is provided with one or more openings to provide fluid communication between said conduit or manifold and said outside surface of said liner.

13. A system according to claim 12 wherein said baffle means is in the form of a plate shaped or otherwise configured to be spaced from a side wall of said receptacle.

* * * * *